US008451976B2

(12) United States Patent
Canfield

(10) Patent No.: US 8,451,976 B2
(45) Date of Patent: May 28, 2013

(54) CATHODE ASSEMBLY FOR AN X-RAY TUBE

(75) Inventor: Bradley D. Canfield, Orem, UT (US)

(73) Assignee: Varian Medical Systems, Inc., Palo Alto, CA (US)

( * ) Notice: Subject to any disclaimer, the term of this patent is extended or adjusted under 35 U.S.C. 154(b) by 167 days.

(21) Appl. No.: 12/847,947

(22) Filed: Jul. 30, 2010

(65) Prior Publication Data

US 2012/0027182 A1 Feb. 2, 2012

(51) Int. Cl.
*H01J 35/06* (2006.01)

(52) U.S. Cl.
USPC ..... 378/136; 378/138

(58) Field of Classification Search
USPC ..... 378/119, 121, 122, 136, 138
See application file for complete search history.

(56) References Cited

U.S. PATENT DOCUMENTS 5,623,530 A 4/1997 Lu et al.
6,762,540 B2 * 7/2004 Schaefer et al. ..... 313/302

* cited by examiner

*Primary Examiner* — Jurie Yun
(74) *Attorney, Agent, or Firm* — Maschoff Brennan

(57) ABSTRACT

A cathode assembly for an x-ray tube. In one example embodiment, a cathode assembly includes a cathode head, a filament, and first and second focusing tabs. The cathode head defines a recess having first and second open ends, a slot within the recess, and first and second tab stops within the recess. The filament is positioned within the slot. The first focusing tab is positioned in the first open end of the recess abutting the first tab stop. The second focusing tab is positioned in the second open end of the recess abutting the second tab stop.

20 Claims, 7 Drawing Sheets

CATHODE ASSEMBLY FOR AN X-RAY TUBE

BACKGROUND

The x-ray tube has become common in medical diagnostic imaging, medical therapy, and various medical testing and material analysis industries. Such equipment is commonly employed in areas such as medical diagnostic examination, therapeutic radiology, semiconductor fabrication, and materials analysis.

An x-ray tube typically includes an evacuated enclosure within which a cathode and an anode are positioned. The cathode of the x-ray tube generally includes a source of highly energized electrons. The anode of the x-ray tube includes a focal track, which is generally manufactured from a refractory metal such as tungsten and is oriented to receive electrons emitted by the cathode.

During operation of the x-ray tube, the cathode may be charged with a current that causes electrons to "boil" off the electron source by the process of thermionic emission. An electric potential can be applied between the cathode and the anode in order to accelerate electrons emitted by the electron source toward the focal track of the anode. X-rays are generated when the highly accelerated electrons strike the focal track. Some of the x-rays that are produced by these processes ultimately exit the x-ray tube through a window and interact with a patient, a material sample, or another object.

It is generally desirable to maximize the focusing of the electron stream on the anode surface in order to produce a tightly collimated x-ray beam. It is well understood that the quality of diagnostic images additionally depends on the pattern, or focal spot, created by the emitted beam of electrons from the cathode onto the focal track of the anode. In general, a smaller focal spot produces a more highly focused or collimated beam of x-rays, which in turn produces better quality x-ray images.

The characteristics of the focal spot may be affected by the configuration of the components of the cathode. However, many cathode assemblies are configured in such a way that they impair the effectiveness with which the focal spot can be defined and/or maintained.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF SOME EXAMPLE EMBODIMENTS

In general, example embodiments relate to a cathode assembly for an x-ray tube. The example cathode assembly disclosed herein includes a cathode head, one or more filaments, and focusing tabs abutted against tab stops defined by the cathode head. The tab stops defined by the cathode head enable the tabs to be precisely positioned in relation to the filament(s) in order to precisely focus the electron stream emitted by the filament(s) on an anode surface in order to produce a tightly collimated x-ray beam, which produces better quality x-ray images.

In one example embodiment, a cathode assembly includes a cathode head, a filament, and first and second focusing tabs. The cathode head defines a recess having first and second open ends, a slot within the recess, and first and second tab stops within the recess. The filament is positioned within the slot. The first focusing tab is positioned in the first open end of the recess abutting the first tab stop. The second focusing tab is positioned in the second open end of the recess abutting the second tab stop.

In another example embodiment, a cathode assembly includes a cathode head, first and second filaments, and first and second focusing tabs. The cathode head defines a recess having first and second open ends, first and second slots within the recess, and first, second, third, and fourth tab stops within the recess. The first and second filaments are positioned within the first and second slots, respectively. The first focusing tab is positioned in the first open end of the recess abutting the first and third tab stops. The second focusing tab is positioned in the second open end of the recess abutting the second and fourth tab stops.

In yet another example embodiment, an x-ray tube includes an evacuated enclosure, an anode at least partially positioned within the evacuated enclosure, and a cathode assembly at least partially positioned within the evacuated enclosure. The cathode assembly includes a cathode head, a filament, and first and second focusing tabs. The cathode head defines a recess having first and second open ends, a slot within the recess, and first and second tab stops within the recess. The filament is positioned within the slot. The first focusing tab is positioned in the first open end of the recess abutting the first tab stop. The second focusing tab is positioned in the second open end of the recess abutting the second tab stop.

These and other aspects of example embodiments of the invention will become more fully apparent from the following description and appended claims.

BRIEF DESCRIPTION OF THE DRAWINGS

To further clarify certain aspects of the present invention, a more particular description of the invention will be rendered by reference to example embodiments thereof which are disclosed in the appended drawings. It is appreciated that these drawings depict only example embodiments of the invention and are therefore not to be considered limiting of its scope. Aspects of example embodiments of the invention will be described and explained with additional specificity and detail through the use of the accompanying drawings in which.

DETAILED DESCRIPTION OF SOME EXAMPLE EMBODIMENTS

Example embodiments of the present invention relate to a cathode assembly for an x-ray tube. The example cathode assembly disclosed herein includes a cathode head, one or more filaments, and focusing tabs abutted against tab stops defined by the cathode head. The tab stops defined by the cathode head enable the tabs to be precisely positioned in relation to the filament(s) in order to precisely focus the length of the electron stream emitted by the filament(s) on an anode surface in order to produce a tightly collimated x-ray beam, which produces better quality x-ray images.

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

I. Example X-Ray Tube

Figure 1A:
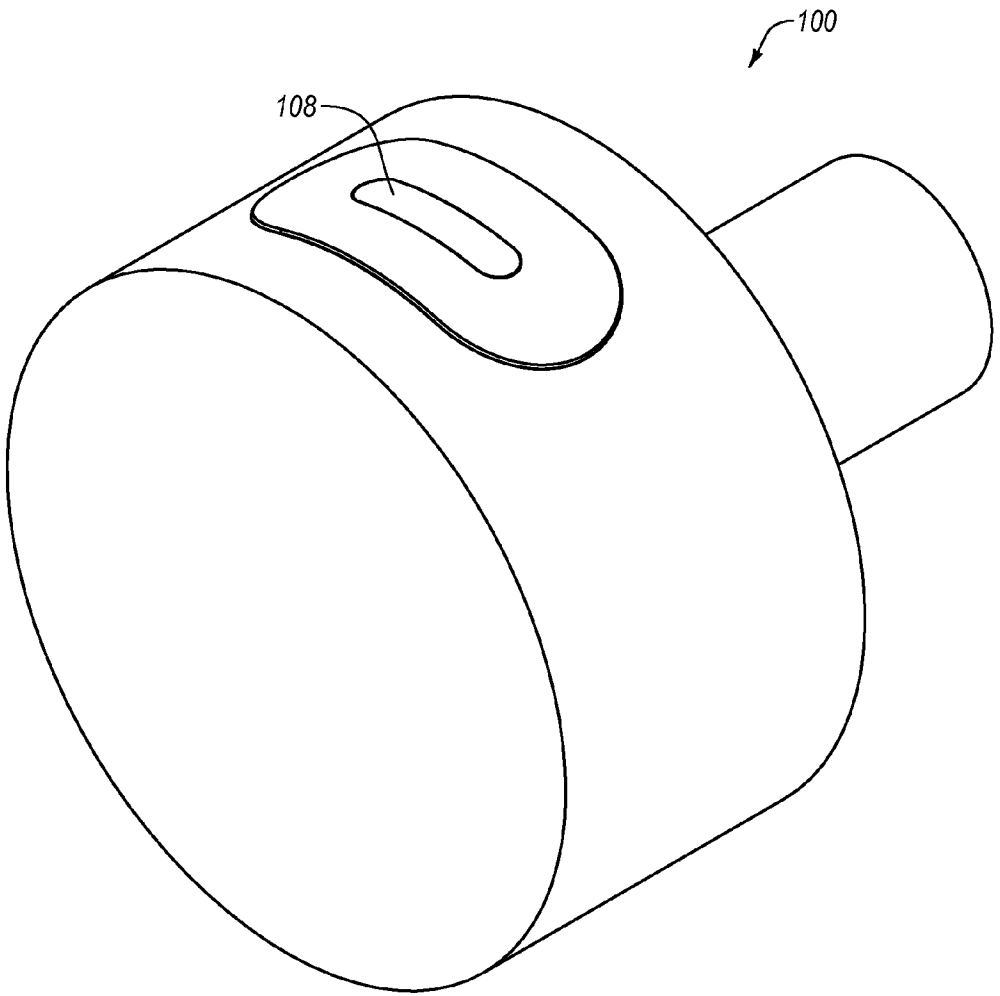
FIG. 1A is a schematic view of an example x-ray tube.
Figure 1B:
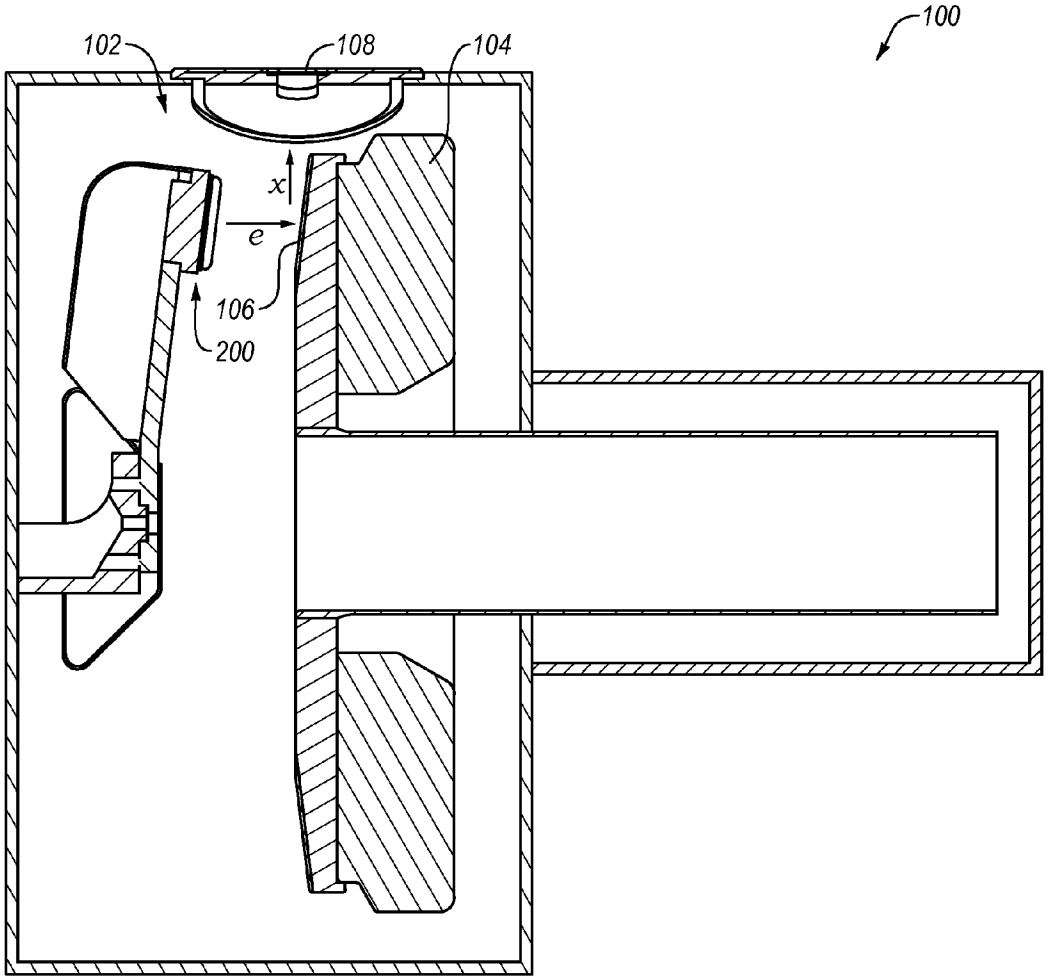
FIG. 1B is a cross-sectional side view of the example x-ray tube of FIG. 1A which includes an example cathode assembly.

With reference first to FIGS. 1A and 1B, an example x-ray tube 100 is disclosed. The x-ray tube 100 is a rotating anode type x-ray tube and includes a evacuated enclosure 102 within which an anode 104 and a cathode assembly 200 are positioned. The anode 104 is spaced apart from and oppositely disposed to the cathode assembly 200. The anode 104 and cathode assembly 200 are connected in an electrical circuit that allows for the application of a high voltage potential between the anode 104 and the cathode assembly 200. The cathode assembly 200 includes first and second filaments 204 and 206 (see FIGS. 2A-2E) configured as electron emitters and connected to an appropriate power source (not shown).

As disclosed in FIG. 1B, prior to operation of the example x-ray tube 100, the evacuated enclosure 102 is evacuated to create a vacuum. Then, during operation of the example x-ray tube 100, an electrical current is passed through the first and second filaments 204 and 206 (see FIGS. 2A-2E) of the cathode assembly 200 to cause electrons "e" to be emitted from the cathode assembly 200 by thermionic emission. The application of a high voltage differential between the anode 104 and the cathode assembly 200 then causes the electrons "e" to accelerate from the first and second filaments 204 and 206 (see FIGS. 2A-2E) toward a focal track 106 that is positioned on the anode 104. The focal track 106 may be composed for example of tungsten and rhenium or other material (s) having a high atomic ("high Z") number. As the electrons "e" accelerate, they gain a substantial amount of kinetic energy, and upon striking the rotating focal track 106, some of this kinetic energy is converted into x-rays "x".

The focal track 106 is oriented so that emitted x-rays "x" are visible to an x-ray tube window 108. As the x-ray tube window 108 is comprised of an x-ray transmissive material, the x-rays "x" emitted from the focal track 106 pass through the x-ray tube window 108 in order to strike an intended subject (not shown) to produce an x-ray image (not shown). The window 108 therefore seals the vacuum of the evacuated enclosure 102 of the x-ray tube 100 from the atmospheric air pressure outside the x-ray tube 100, and yet enables x-rays "x" generated by the anode 104 to exit the x-ray tube 100.

The cathode assembly 200 is configured to maximize the focusing of the length of the electron stream "e" on the focal track 106 of the anode 104 in order to produce a tightly collimated x-ray beam "x", which produces better quality x-ray images. This focusing of the length of the electron stream "e" on the focal track 106 is accomplished by the tab stops and focusing tabs described below in connection with FIGS. 2A-2D.

II. Example Cathode Assembly

With reference now to FIGS. 2A-2D, additional aspects of the example cathode assembly 200 are disclosed. As disclosed in FIG. 2A, the cathode assembly 200 generally includes a cathode head 202, first and second filaments 204 and 206, and first and second focusing tabs 208 and 210.

The cathode head 202 defines a recess 212 having first and second open ends 214 and 216. The cathode head 202 also defines first and second slots 218 and 220 within the recess 212 and a pair of feed through holes 222 in the bottom of each of the first and second slots 218 and 220. As disclosed in FIGS. 2B-2D, while the cathode assembly 200 is being assembled, the first and second filaments 204 and 206 are positioned in the first and second slots 218 and 220, respectively. As disclosed in FIG. 2E, the second filament 206 extends through the feed through holes 222 in the second slot 220. Similarly, the first filament 204 extends through the feed through holes 222 in the first slot 218.

Figure 2A:
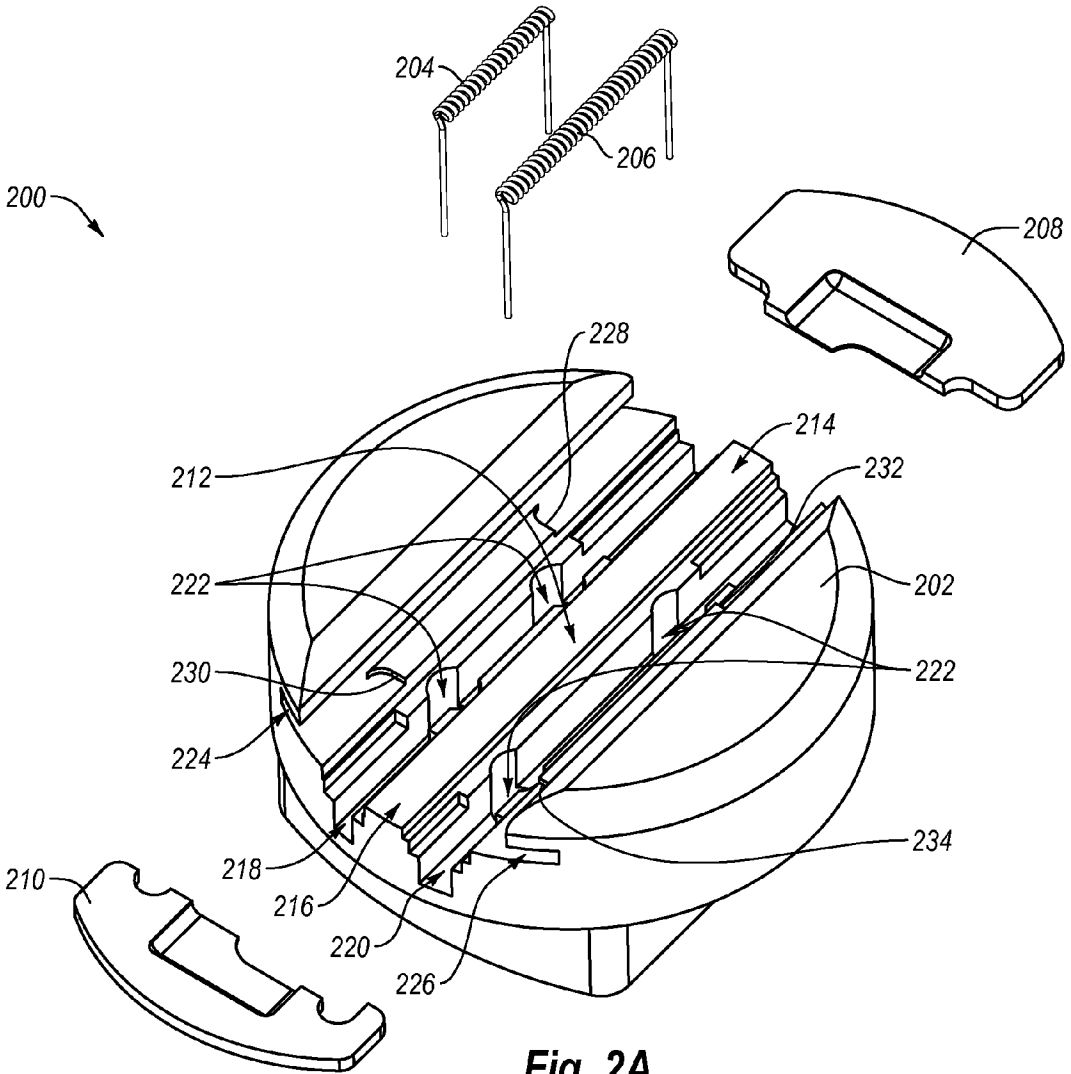
FIG. 2A is perspective exploded view of the example cathode assembly of FIG. 1B.
Figure 2B:
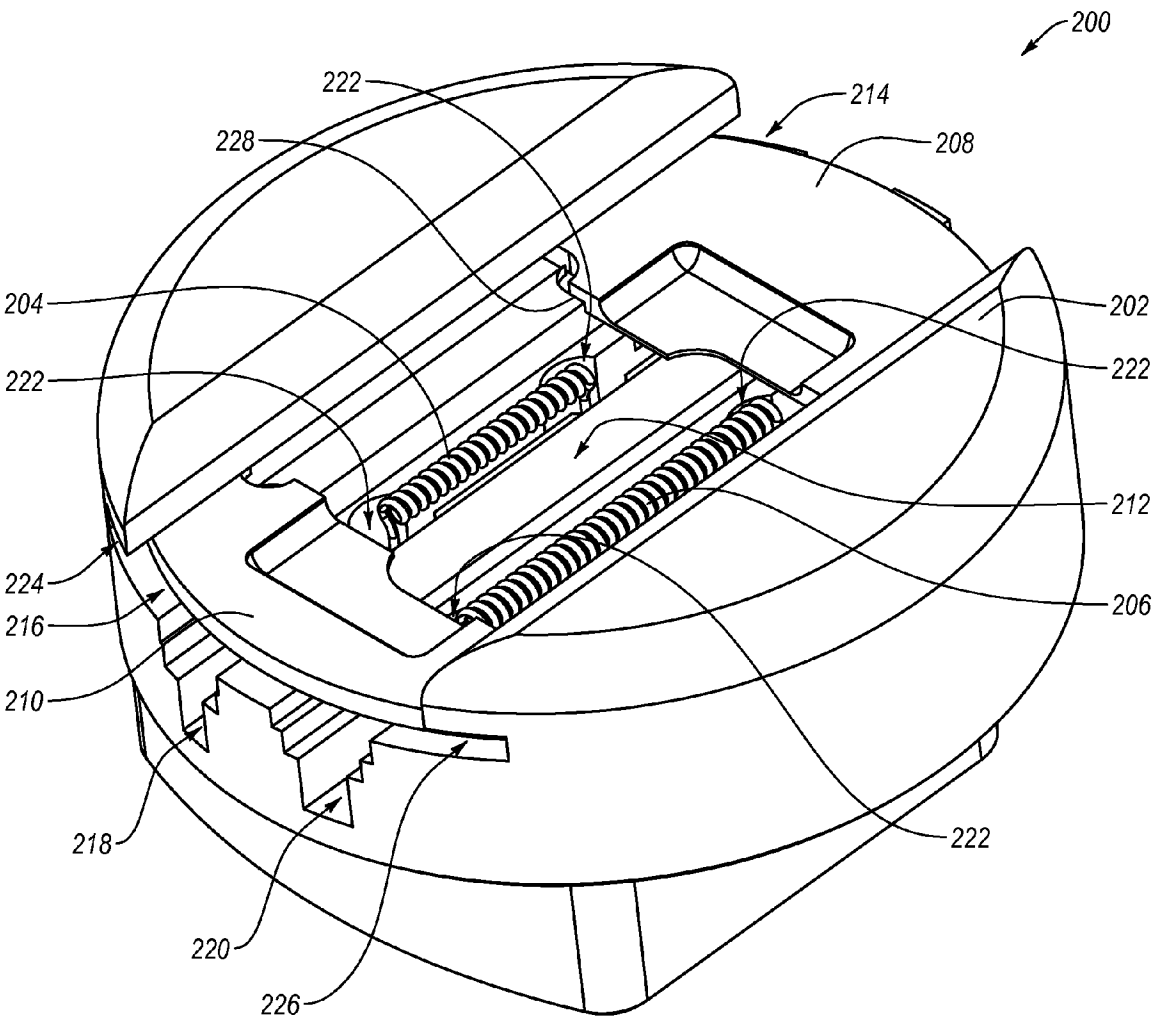
FIG. 2B is perspective assembled view of the example cathode assembly of FIG. 1B.
Figure 2C:
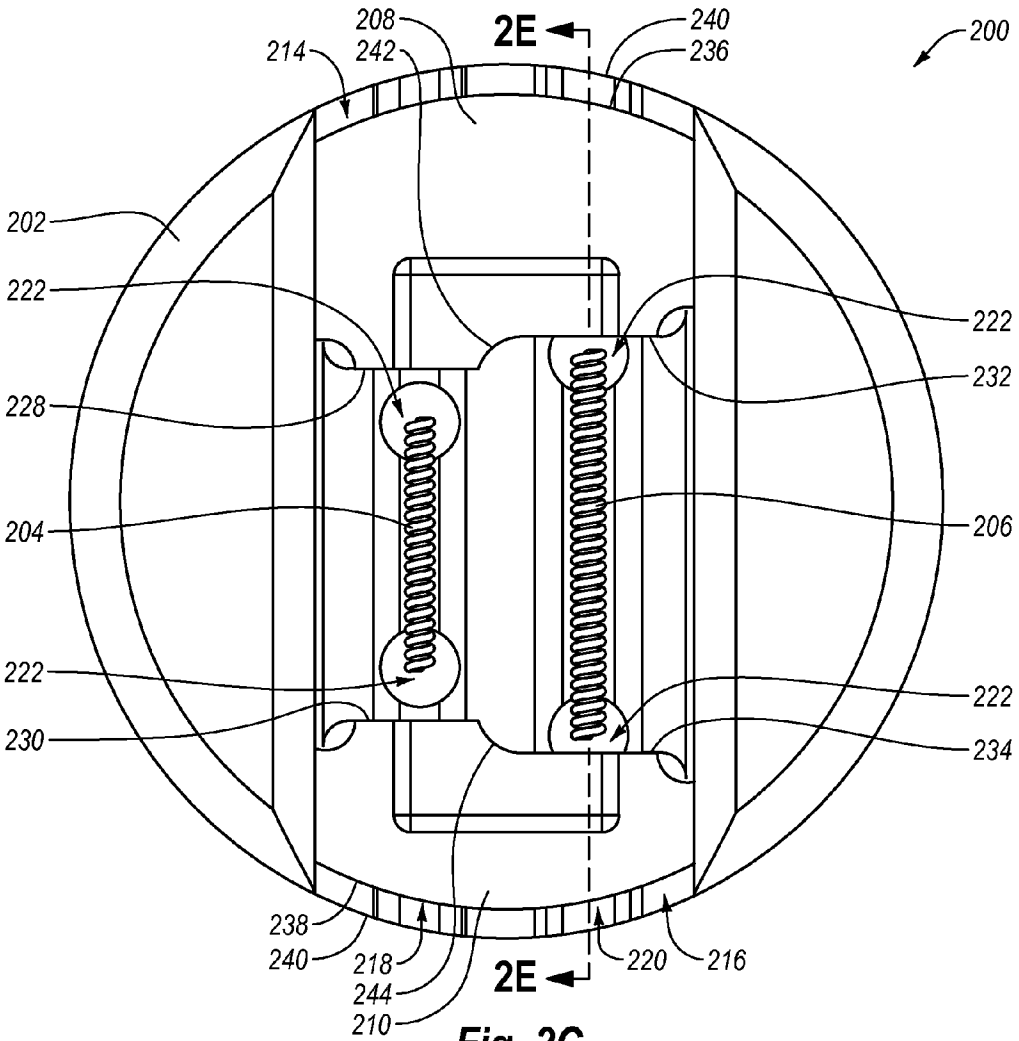
FIG. 2C is a front view of the example cathode assembly of FIG. 2A.
Figure 2D:
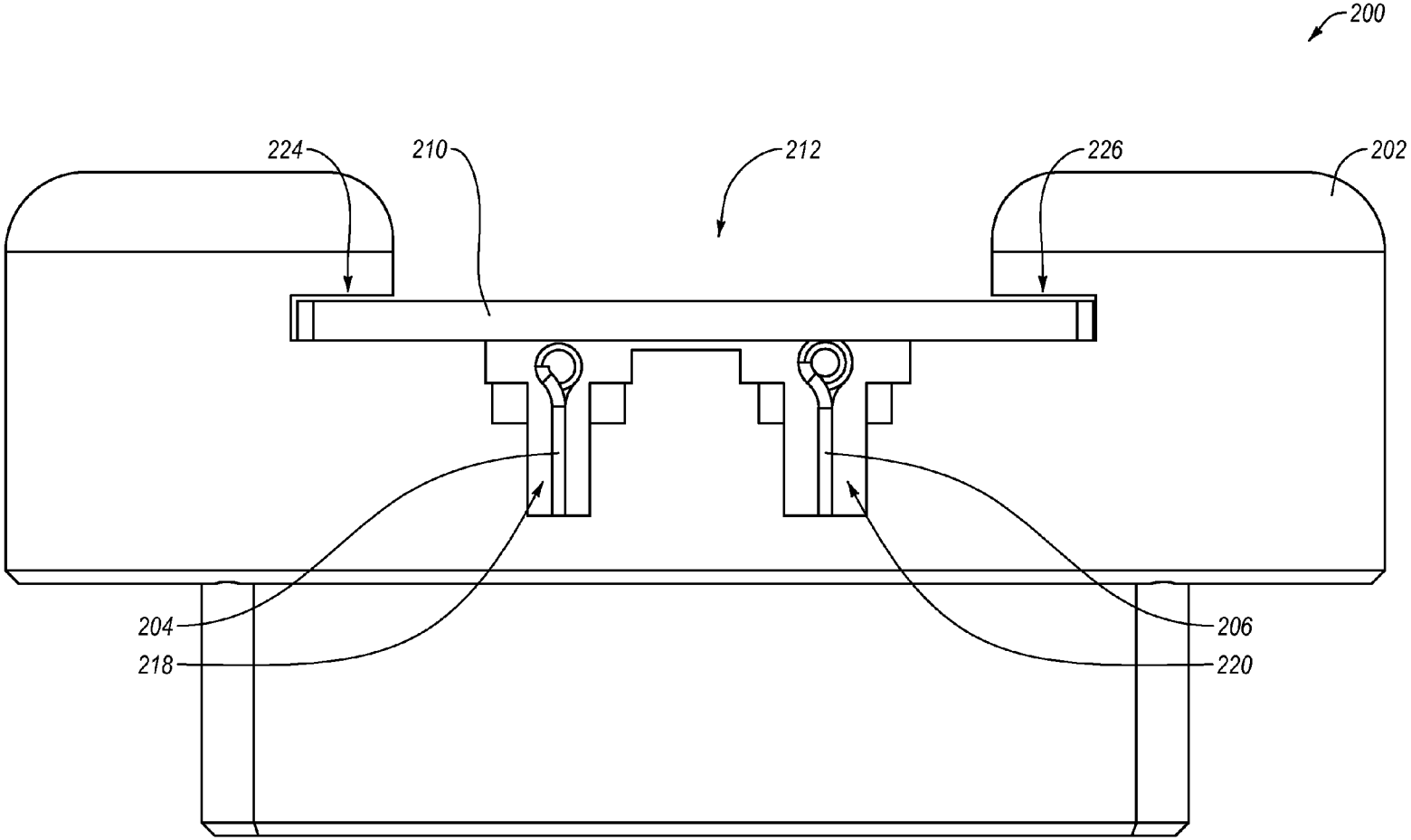
FIG. 2D is a side view of the example cathode assembly of FIG. 2A.
Figure 2E:
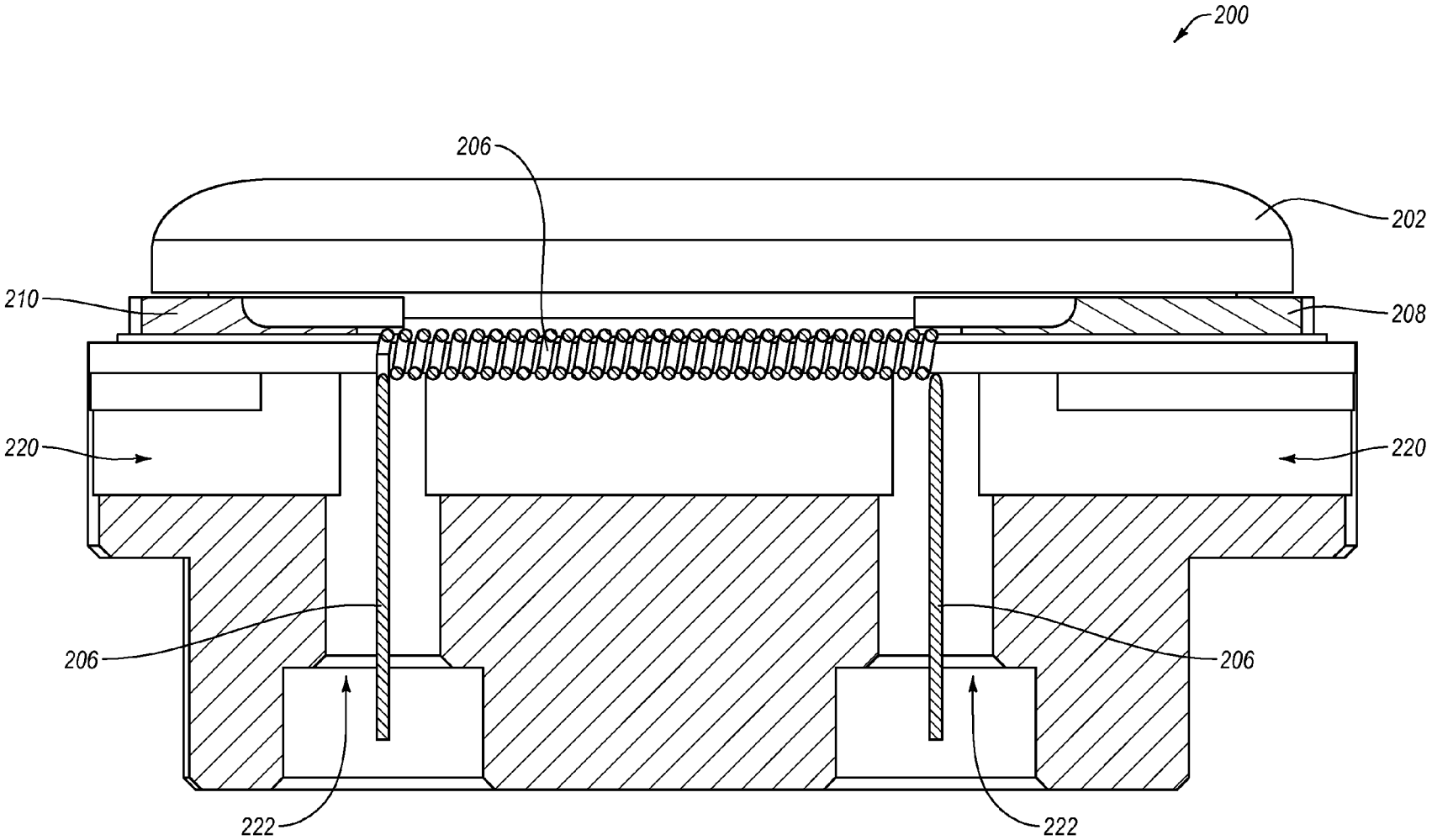
FIG. 2E is a cross-sectional top view of the example cathode assembly of FIG. 2A.

As disclosed in FIGS. 2A, 2B, and 2D, the cathode head 202 also defines first and second grooves 224 and 226 running the length of either side of the recess 212. As disclosed in FIGS. 2A-2C, the cathode head 202 further defines first, second, third, and fourth tab stops 228-234 within the recess 212. The first, second, third, and fourth tab stops 228-234 are precision machined into the cathode head 202 and precisely positioned in relation to the feed through holes 222. This precise positioning of the tab stops 228-234 in relation to the feed through holes 222 may be accomplished by referencing the tab stops 228-234 and the feed through holes 222 to the same locating reference during the precision machining process.

As disclosed in FIGS. 2A and 2B, while the cathode assembly 200 is being assembled, and after the first and second filaments 204 and 206 are positioned in the first and second slots 218 and 220, respectively, the first focusing tab 208 is slid into the first open end 214 of the recess 212, and the edges of the first focusing tab 208 are slid into the grooves 224 and 226, until the first focusing tab 208 abuts the first and third tab stops 228 and 232. Similarly, the second focusing tab 210 is slid into the second open end 216 of the recess 212, and the edges of the second focusing tab 210 are slid into the grooves 224 and 226, until the second focusing tab 210 abuts the second and fourth tab stops 230 and 234. Once the first focusing tab 208 abuts the first and third tab stops 228 and 232, and the second focusing tab 210 abuts the second and fourth tab stops 230 and 234, the first and second focusing tabs 208 and 210 are fixed to the cathode head 202.

The precision machining of the first, second, third, and fourth tab stops 228-234 in relation to the feed through holes 222 enables the first and second focusing tabs 208 and 210 to be precisely positioned in relation to the first and second filaments 204 and 206. The precise positioning of the focusing tabs 208 and 210 can be accomplished easily and reliably by merely sliding the first focusing tab 208 until it abuts the first and third tab stops 228 and 232 and by sliding the second focusing tab 210 until it abuts the second and fourth tab stops 230 and 234. In addition, adjustment of the focusing of the first and second filaments 204 and 206 can be easily accomplished by changing the positions of the tab stops 228-234.

The tabs stops 228-234 thus enable precise positioning of the focusing tabs 208 and 210 without measurement, inspection, precision tools, and/or other time-consuming and error-prone procedures. For example, as disclosed in FIG. 2C, the outer edges 236 and 238 of the first and second focusing tabs 208 and 210 are not coextensive with an outer periphery 240 of the cathode head 202. Requiring the outer edges 236 and 238 of the first and second focusing tabs 208 and 210 to be coextensive with an outer periphery 240 of the cathode head 202 is an inherently less reliable form of alignment than the use of the tabs stops 228-234.

The tabs stops 228-234 thus enable precise positioning of the focusing tabs 208 and 210 in relation to the filaments 204 and 206 in order to precisely focus the length of the electron stream emitted by the filaments 204 and 206 on the focal track 106 (see FIG. 1B) in order to produce a tightly collimated x-ray beam, which produces better quality x-ray images.

In addition, as disclosed in FIG. 2C, the leading edges 242 and 244 of the first and second focusing tabs 208 and 210 are contoured such that the first and second focusing tabs 208 and 210 cover more of the first slot 218 than the second slot 220, which enables precise focusing of the length of the electron stream emitted by the filaments 204 and 206 even where the second filament 206 has a greater length than the first filament 204. In addition, adjustment of the focusing of the first and second filaments 204 and 206 can be easily accomplished by changing the contours of the leading edges 242 and 244 of the first and second focusing tabs 208 and 210.

Although the example cathode assembly 200 disclosed in FIGS. 2A-2E include two slots with two filaments, it is understood that the example cathode assembly may only include a single filament, or may include three or more filaments. The leading edges 242 and 244 of the first and second focusing tabs 208 and 210 may be contoured to accommodate filaments of various lengths. Further, although the example cathode assembly 200 disclosed in FIGS. 2A-2E includes two tab stops for each focusing tab, it is understood that each focusing tab may be precisely positioned using a single tab stop or three or more tab stops.

Finally, although the x-ray tube 100 is a rotating anode type x-ray tube, the example cathode assembly 200 can be utilized in any type of x-ray tube having an evacuated enclosure with an anode and the example cathode assembly 200 at least partially positioned within the evacuated enclosure. For example, the example cathode assembly 200 can be utilized in a stationary anode type x-ray tube.

The example embodiments disclosed herein may be embodied in other specific forms. The example embodiments disclosed herein are therefore to be considered in all respects only as illustrative and not restrictive.

What is claimed is:

1. A cathode assembly comprising:

a cathode head defining a recess having first and second open ends, a slot within the recess, and first and second tab stops within the recess;

a filament positioned within the slot;

a first focusing tab positioned in the first open end of the recess abutting the first tab stop; and a second focusing tab positioned in the second open end of the recess abutting the second tab stop.

2. The cathode assembly as recited in claim 1, wherein the first and second focusing tabs are not coextensive with an outer periphery of the cathode head.

3. The cathode assembly as recited in claim 1, wherein:

the cathode head further defines a second slot within the recess; and the cathode assembly further comprises a second filament positioned within the second slot.

4. The cathode assembly as recited in claim 3, wherein the cathode head further defines third and fourth tab stops within the recess.

5. The cathode assembly as recited in claim 4, wherein the first focusing tab further abuts the third tab stop and the second focusing tab further abuts the fourth tab stop.

6. The cathode assembly as recited in claim 5, wherein the first and second focusing tabs cover more of the slot than the second slot.

7. A cathode assembly comprising:

a cathode head defining a recess having first and second open ends, first and second slots within the recess, and first, second, third, and fourth tab stops within the recess;

first and second filaments positioned within the first and second slots, respectively;

a first focusing tab positioned in the first open end of the recess abutting the first and third tab stops; and a second focusing tab positioned in the second open end of the recess abutting the second and fourth tab stops.

8. The cathode assembly as recited in claim 7, wherein the first and second slots each define a pair of feed through holes through which the first and second filaments extend, respectively.

9. The cathode assembly as recited in claim 7, wherein the cathode head further defines first and second grooves running the length of either side of the recess.

10. The cathode assembly as recited in claim 9, wherein the first and second focusing tabs are each partially positioned within the first and second grooves.

11. The cathode assembly as recited in claim 7, wherein the first and second focusing tabs are not coextensive with an outer periphery of the cathode head.

12. The cathode assembly as recited in claim 7, wherein the first and second focusing tabs cover more of the first slot than the second slot.

13. An x-ray tube comprising:

an evacuated enclosure;

an anode at least partially positioned within the evacuated enclosure; and a cathode assembly at least partially positioned within the evacuated enclosure, the cathode assembly comprising:

a cathode head defining a recess having first and second open ends, a slot within the recess, and first and second tab stops within the recess;

a filament positioned within the slot;

a first focusing tab positioned in the first open end of the recess abutting the first tab stop; and a second focusing tab positioned in the second open end of the recess abutting the second tab stop.

14. The x-ray tube as recited in claim 13, wherein the first and second focusing tabs are not coextensive with an outer periphery of the cathode head.

15. The x-ray tube as recited in claim 13, wherein:

the cathode head further defines third and fourth tab stops within the recess; and the first focusing tab further abuts the third tab stop and the second focusing tab further abuts the fourth tab stop.

16. The x-ray tube as recited in claim 13, wherein the cathode head further defines a second slot within the recess; and the cathode assembly further comprises a second filament positioned within the second slot.

17. The x-ray tube as recited in claim 16, wherein the first and second focusing tabs cover more of the slot than the second slot.

18. The x-ray tube as recited in claim 16, wherein the first and second slots each define a pair of feed through holes through which the first and second filaments extend, respectively.

19. The x-ray tube as recited in claim 16, wherein the cathode head further defines first and second grooves running the length of either side of the recess.

20. The x-ray tube as recited in claim 19, wherein the first and second focusing tabs are each partially positioned within the first and second grooves.

* * * * *